US005324242A

United States Patent [19]

Lo

[11] Patent Number: 5,324,242

[45] Date of Patent: Jun. 28, 1994

[54] EXERCISE APPARATUS WITH MAGNET-TYPE RESISTANCE GENERATOR

[76] Inventor: Peter Kun-Chuan Lo, No. 3, Ching-Chen-Ssu St., Hsi Dist. Taichung, Taiwan

[21] Appl. No.: 141,230

[22] Filed: Oct. 26, 1993

[51] Int. Cl.[5] ..... A63B 69/16; A63B 21/24

[52] U.S. Cl. ..... 482/63; 482/903

[58] Field of Search ..... 482/57, 63, 903, 64; 74/572

[56] References Cited

U.S. PATENT DOCUMENTS 5,094,447 3/1992 Wang ..... 482/63

5,145,480 9/1992 Wang ..... 482/63

*Primary Examiner*—Stephen R. Crow

*Attorney, Agent, or Firm*—Oblon, Spivak, McClelland, Maier & Neustadt

[57] ABSTRACT

An exercise apparatus includes a frame assembly, a flywheel unit mounted rotatably on the frame assembly, a manually operated driving unit for driving rotatably the flywheel unit, and a magnet-type resistance generator to provide resistance to rotation of the flywheel unit. The resistance generator includes a central shaft mounted on the frame assembly and formed with an intermediate worm section, and a rotary plate mounted rotatably on the central shaft on one side of the worm section and driven rotatably by the flywheel unit. The rotary plate has a circular plate portion and a peripheral ring which extends from a front side of the circular plate portion. A movable slide seat is mounted movably on the central shaft and is provided with a worm shaft unit which meshes with the worm section. The slide seat has an outer periphery which is provided with a plurality of angularly spaced magnets that are disposed adjacent to the peripheral ring of the rotary plate. A motor control unit activates a motor to rotate the worm shaft unit and cause movement of the slide seat relative to the rotary plate to vary the strength of a magnetic field applied by the magnets on the peripheral ring of the rotary plate and vary correspondingly magnetic resistance to rotation of the rotary plate and the flywheel unit.

3 Claims, 9 Drawing Sheets

EXERCISE APPARATUS WITH MAGNET-TYPE RESISTANCE GENERATOR

BACKGROUND OF THE INVENTION

1. Field of the Invention

The invention relates to an exercise apparatus, more particularly to an exercise apparatus with an improved magnet-type resistance generator.

2. Description of the Related Art

Exercise apparatuses with magnet-type resistance generators are known in the art. FIGS. 1 and 2 illustrate a conventional exercise bicycle which incorporates a magnet-type resistance generator. The resistance generator includes a magnet unit (B) which pivots frontward and rearward and which is disposed adjacent to a periphery of a flywheel (A) of the exercise bicycle. When the magnet unit (B) pivots frontward, the periphery of the flywheel (A) cuts into a magnetic field that is generated by the magnet unit (B). Referring to FIG. 3, the magnet unit (B) utilizes several spaced pairs of oppositely polarized permanent magnets (B1) to generate the magnetic field.

A cantilever (C) is disposed on one side of the flywheel (A). A link mechanism (D) mounts pivotally the magnet unit (B) on the cantilever (C). The link mechanism (D) includes a pair of parallel cranks (D1). A shaft sleeve (D2) is provided on each end of each crank (D1). Each shaft sleeve (D2) is formed with an axial through hole (D3). A rocking arm (E) interconnects the upper ends of the cranks (D1). The rocking arm (E) has a rear side which is secured to a side wall of the magnet unit (B), and a front side which is formed with a spaced pair of frontwardly extending shafts (E1). Each of the shafts (E1) extends into the shaft sleeve (D2) on the upper end of the respective crank (D1). Nuts (D4) engage the distal ends of the shafts (E1) so as to mount the cranks (D1) pivotally on the rocking arm (E). The cantilever (C) has a front side which is formed with a spaced pair of frontwardly extending shafts (C1). Each of the shafts (C1) extends into the shaft sleeve (D2) on the lower end of the respective crank (D1). Nuts (D4) engage the distal ends of the shafts (C1) so as to mount the cranks (D1) pivotally on the cantilever (C). A push piece (D5) is secured on the upper end of one of the cranks (D1). The push piece (D5) is formed with a vertically extending notch (D6). The distal end of a bent pull shaft (F1) is received in the notch (D6) and is movable upwardly and downwardly therein. The other end of the pull shaft (F1) is connected to a slide piece (F2) of a bolt unit (F). The slide piece (F2) is mounted threadedly on a guide bolt (F4) that is driven rotatably by a motor (F3). A gear (F5) is secured on a distal end of the guide bolt (F4). The gear (F5) meshes with another gear (F51) which is driven rotatably by the motor (F3). The upper end of the slide piece (F2) is formed with an upwardly extending rod (F21). A slide potentiometer (F6) is disposed parallel to the guide bolt (F4). The rod (F21) moves a slider (not shown) of the slide potentiometer (F6) frontward and rearward. Referring to FIG. 4, the slide potentiometer (F6) is connected electrically to a voltage sensor. The voltage sensor includes a position sensor (G11) and a position control (G12) and is connected electrically to a microcomputer (G2). The microcomputer (G2) is connected to a motor control unit (G) which, in turn, is connected to the motor (F3) so as to control the rotation of the latter. Referring once more to FIGS. 1 to 4, an instrument control unit (H) is operated so as to adjust the resistance that is to be provided by the bicycle exerciser to the desired level. The microcomputer (G2), which is disposed in the instrument control unit (H), commands the motor control unit (G) to activate the motor (F3) and rotate the gears (F5, F51) in order to rotate correspondingly the guide bolt (F4). The slide piece (F2) moves forward or rearward in accordance with the direction of rotation of the motor (F3) and moves the pull shaft (F1) therewith. Movement of the pull shaft (F1) causes forward or rearward pivoting movement of the link mechanism (D). At the same time, the rod (F21) moves the slider of the slide potentiometer (F6) frontward or rearward, thereby adjusting the resistance output of the latter. The position sensor (G11) and the position control (G12) generate a control signal to the microcomputer (G2) in accordance with the instantaneous resistance output of the slide potentiometer (F6). The microcomputer (G2) continues to command the motor control unit (G) to activate the motor (F3) until the desired resistance to the rotation of the flywheel (A) is attained. When the link mechanism (D) pivots forward, the periphery of the flywheel (A) cuts deeper into the magnetic field that is generated by the magnet unit (B), thereby resulting in a larger resistance to the rotation of the flywheel (A). When the link mechanism (D) pivots rearward, a smaller portion of the periphery of the flywheel (A) cuts into the magnetic field that is generated by the magnet unit (B), thereby resulting in a smaller resistance to the rotation of the flywheel (A). When the flywheel (A) ceases to cut into the magnetic field that is generated by the magnet unit (B), no resistance to the rotation of the flywheel (A) is produced.

From the foregoing, it has been shown that in order to convert the rotation of the motor (F3) into pivoting movement of the link mechanism (D) and the magnet unit (B), movement of several components, such as the gears (F5, F51), the guide bolt (F4), the slide piece (F2), and the pull shaft (F1), is required. This results in a relatively large tolerance. The following are some of the drawbacks of the above described resistance generator:

1. Referring once more to FIGS. 1 and 3, the magnet unit (B) confines a groove (B2) between the spaced pairs of oppositely polarized permanent magnets (B1). The periphery of the flywheel (A) extends into the groove (B2) such that the permanent magnets (B1) are disposed on two sides thereof. In order for the flywheel (A) to cut equally through the magnetic lines of the permanent magnets (B1), the flywheel (A) must be disposed at the center of the groove (B2). However, because of the presence of the relatively large tolerance, the flywheel (A) usually does not cut equally through the magnetic lines. This often results in an unstable resistance to the rotation of the flywheel (A). The exercise apparatus thus becomes uncomfortable to use and can result in uneven muscle development.

2. Proper installation and adjustment of the magnet unit (B) is difficult to achieve. When the magnet unit (B) accidentally bumps into an object, the flywheel (A) is easily displaced from its proper position.

3. Note that the instrument control unit (H) is operable in order to set the desired calorie loss and to compute the actual calorie loss. To compute the calorie loss, two factors are required: the rotational speed of the flywheel (A) in revolutions per minute, and the resistance offered by the resistance generator to the rotation of the flywheel (A). As mentioned hereinbefore, the resistance to the rotation of the flywheel (A) is usually uneven. Thus, the computed calorie loss is usually inaccurate.

SUMMARY OF THE INVENTION

Therefore, the objective of the present invention is to provide an exercise apparatus with an improved magnet-type resistance generator which is capable of overcoming the drawbacks that are commonly associated with the above described prior art.

More specifically, the objective of the present invention is to provide an exercise apparatus with an improved magnet-type resistance generator to ensure that the exercise apparatus is comfortable to use and that the resistance to the rotation of the flywheel is uniform.

Accordingly, the exercise apparatus of the present invention comprises a frame assembly, a flywheel unit mounted rotatably on the frame assembly, a manually operated driving unit for driving rotatably the flywheel unit, and a magnet-type resistance generator to provide resistance to rotation of the flywheel unit. The resistance generator includes: a central shaft mounted on the frame assembly and formed with an intermediate worm section; a rotary plate mounted rotatably on the central shaft on one side of the worm section and driven rotatably by the flywheel unit, the rotary plate being made of a magnetically conductive material and having a circular plate portion and a peripheral ring which extends from a front side of the circular plate portion and which has a predetermined thickness, the rotary plate having a hollow space which is confined by the circular plate portion and the peripheral ring; a movable slide seat disposed axially on the central shaft, the slide seat including mounting means for mounting movably the slide seat along the central shaft and being provided with a worm shaft unit which meshes with the worm section and a motor means for rotating the worm shaft unit, the slide seat extending into the hollow space of the rotary plate and having an outer periphery which is provided with a plurality of angularly spaced magnets that are disposed adjacent to the peripheral ring of the rotary plate; and a motor control means connected to the motor means and operable so as to activate the motor means to rotate the worm shaft unit and cause movement of the slide seat in and out of the hollow space of the rotary plate to vary strength of a magnetic field applied by the magnets on the peripheral ring of the rotary plate and vary correspondingly magnetic resistance to rotation of the rotary plate and the flywheel unit.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
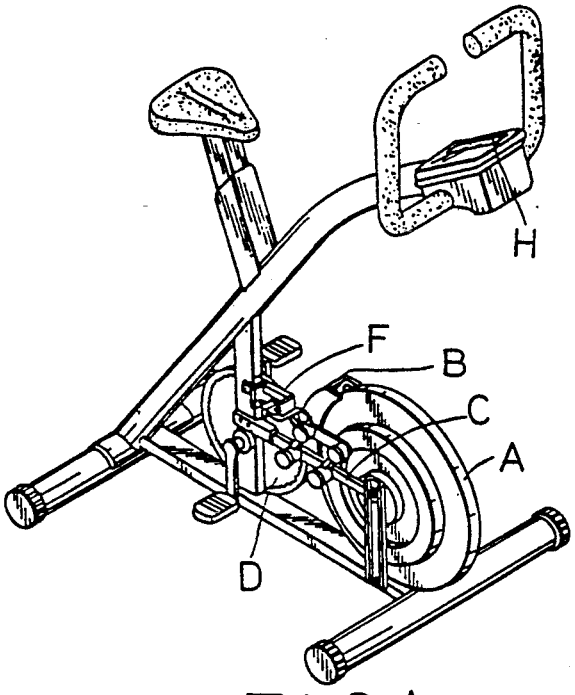
FIG.1 PRIOR ART
FIG. 1 is a perspective view of a conventional exercise apparatus with a magnet-type resistance generator.
Figure 2:
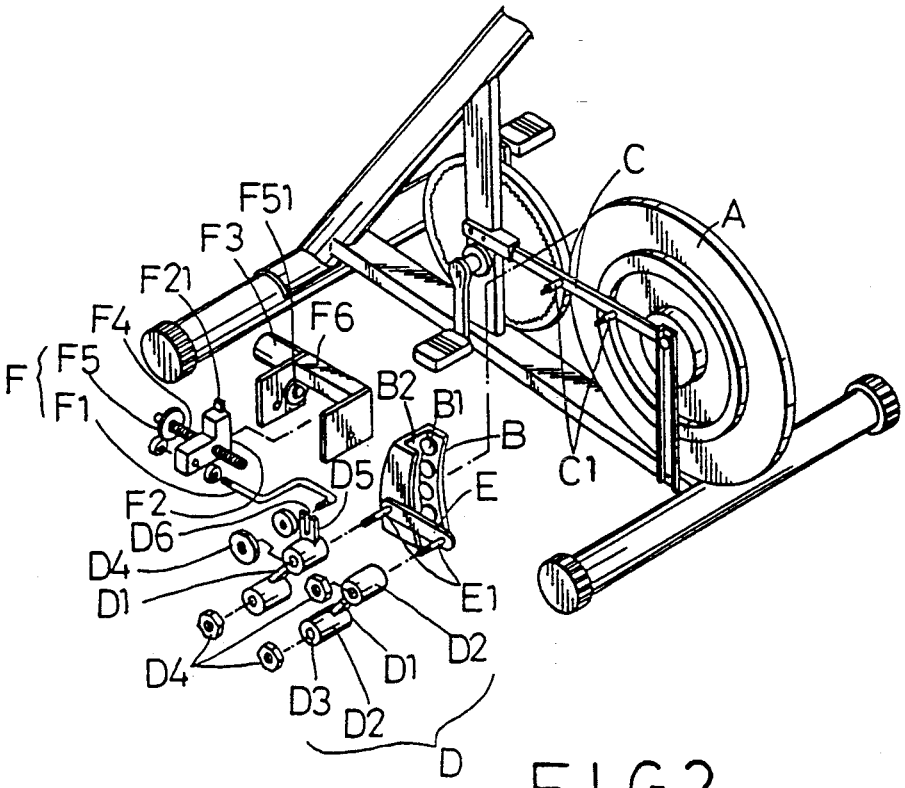
FIG.2 PRIOR ART
FIG. 2 is an exploded view of the conventional magnet-type resistance generator shown in FIG. 1.
Figure 3:
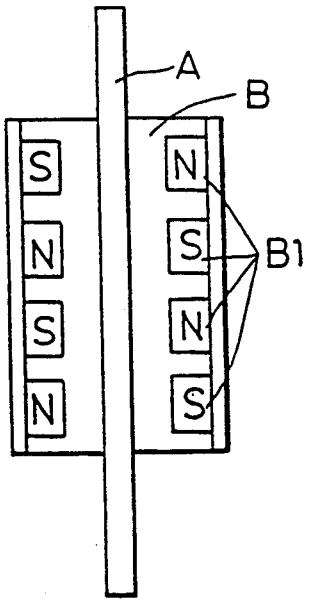
FIG. 3 PRIOR ART
FIG. 3 is a front view illustrating how a magnet unit of the conventional magnet-type resistance generator resists the rotation of a flywheel of the exercise apparatus.
Figure 4:
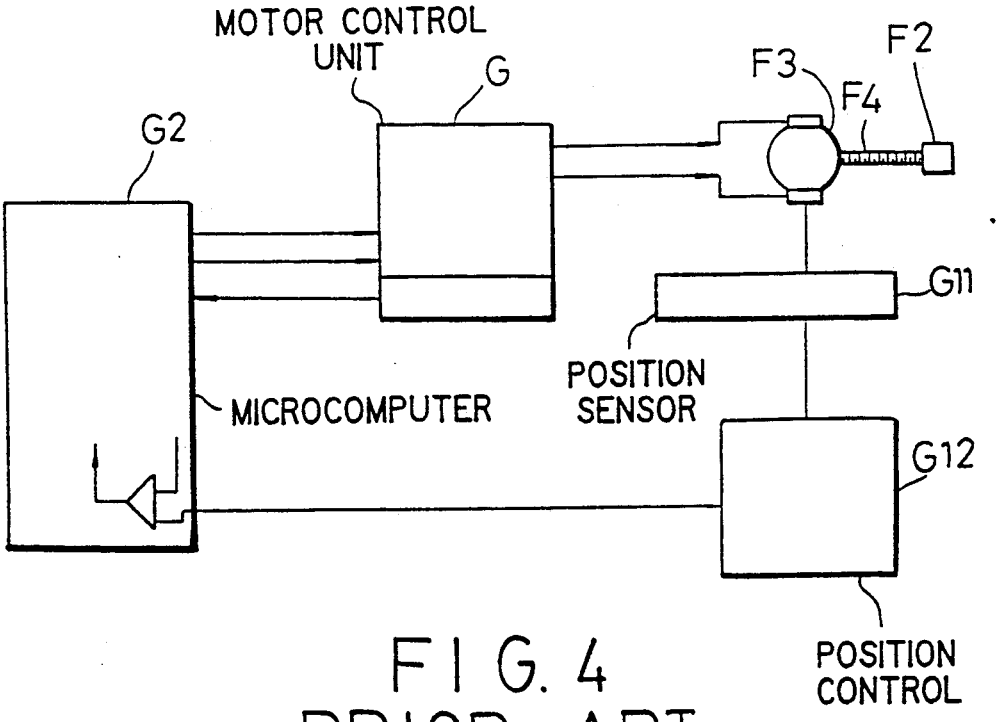
FIG. 4 PRIOR ART
FIG. 4 is a schematic circuit block diagram of a motor control unit of the conventional magnet-type resistance generator.
Figure 5:
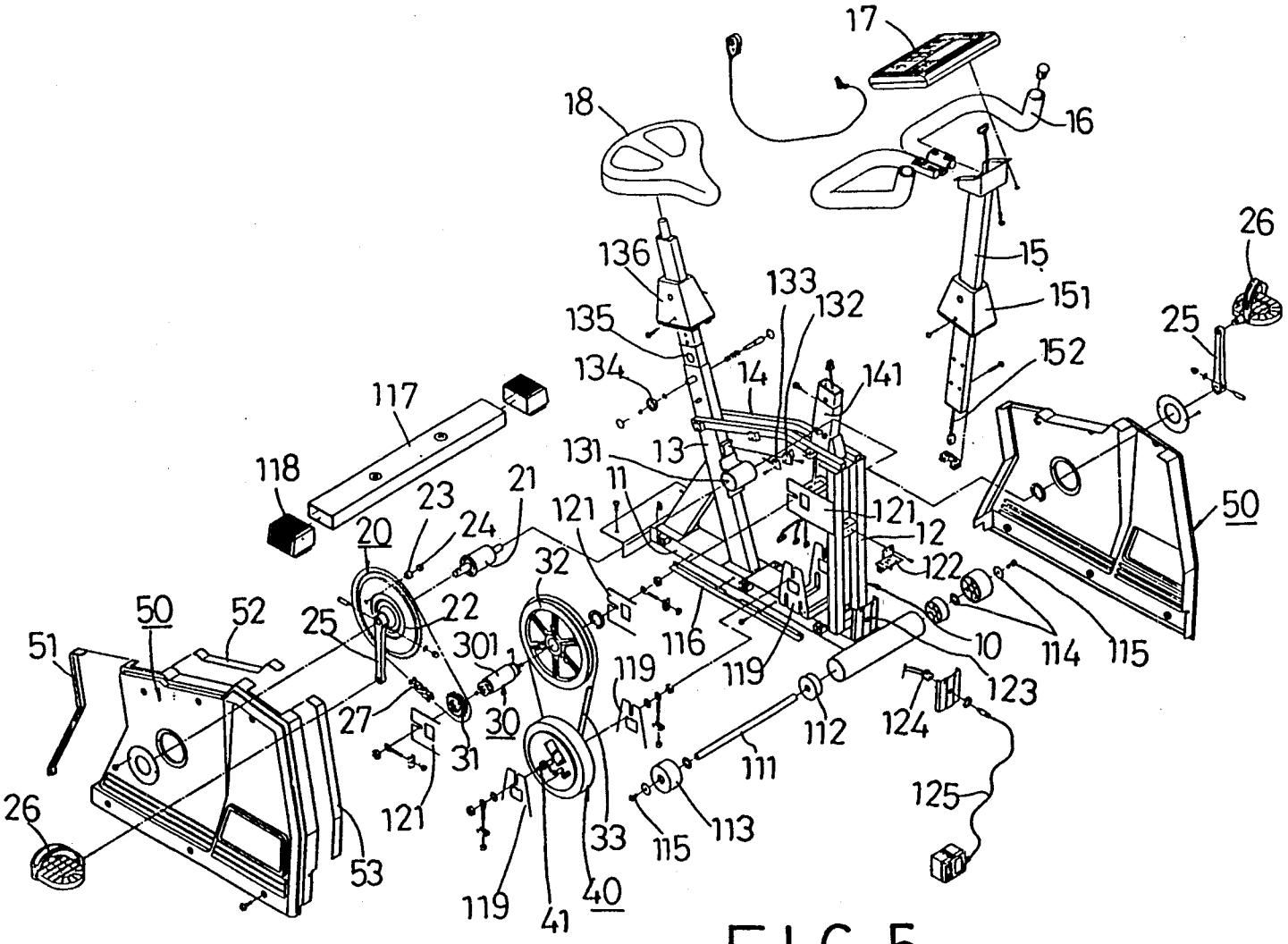
FIG. 5 is an exploded perspective view of the preferred embodiment of an exercise apparatus with an improved magnet-type resistance generator according to the present invention.
Figure 6:
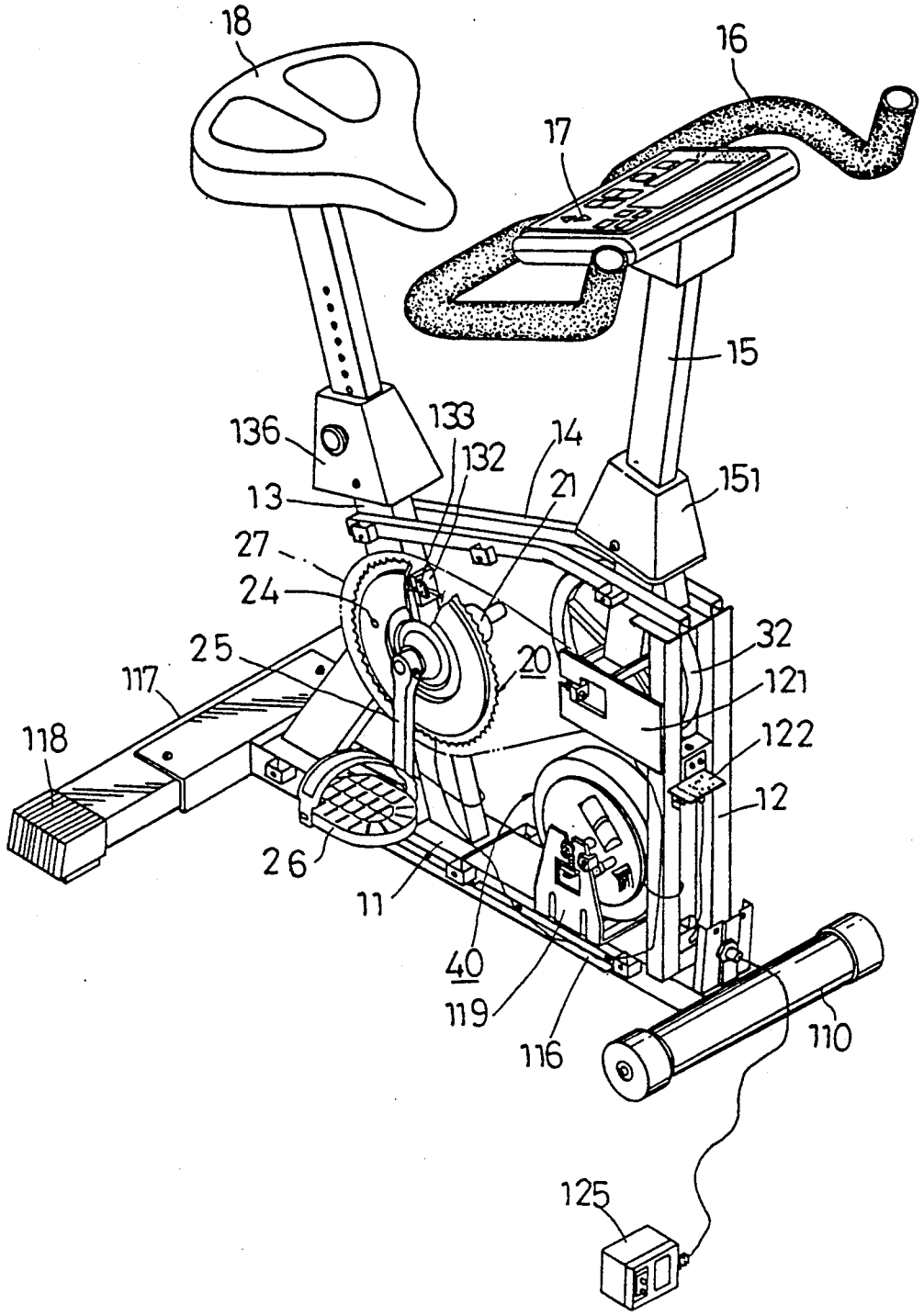
FIG. 6 is a partly assembled perspective view of the preferred embodiment.
Figure 7:
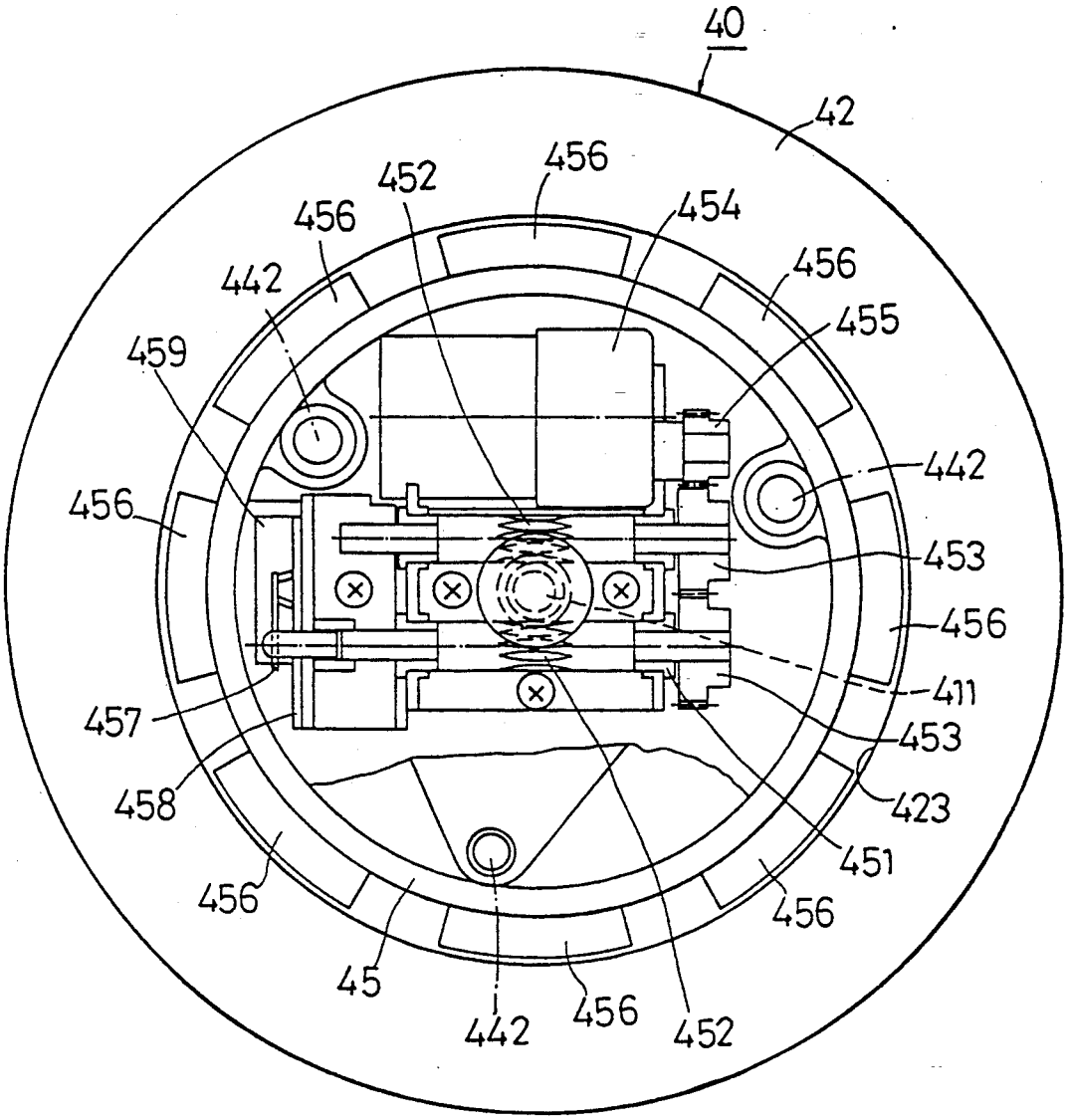
FIG. 7 is a schematic view of the magnet-type resistance generator of the preferred embodiment.
Figure 8:
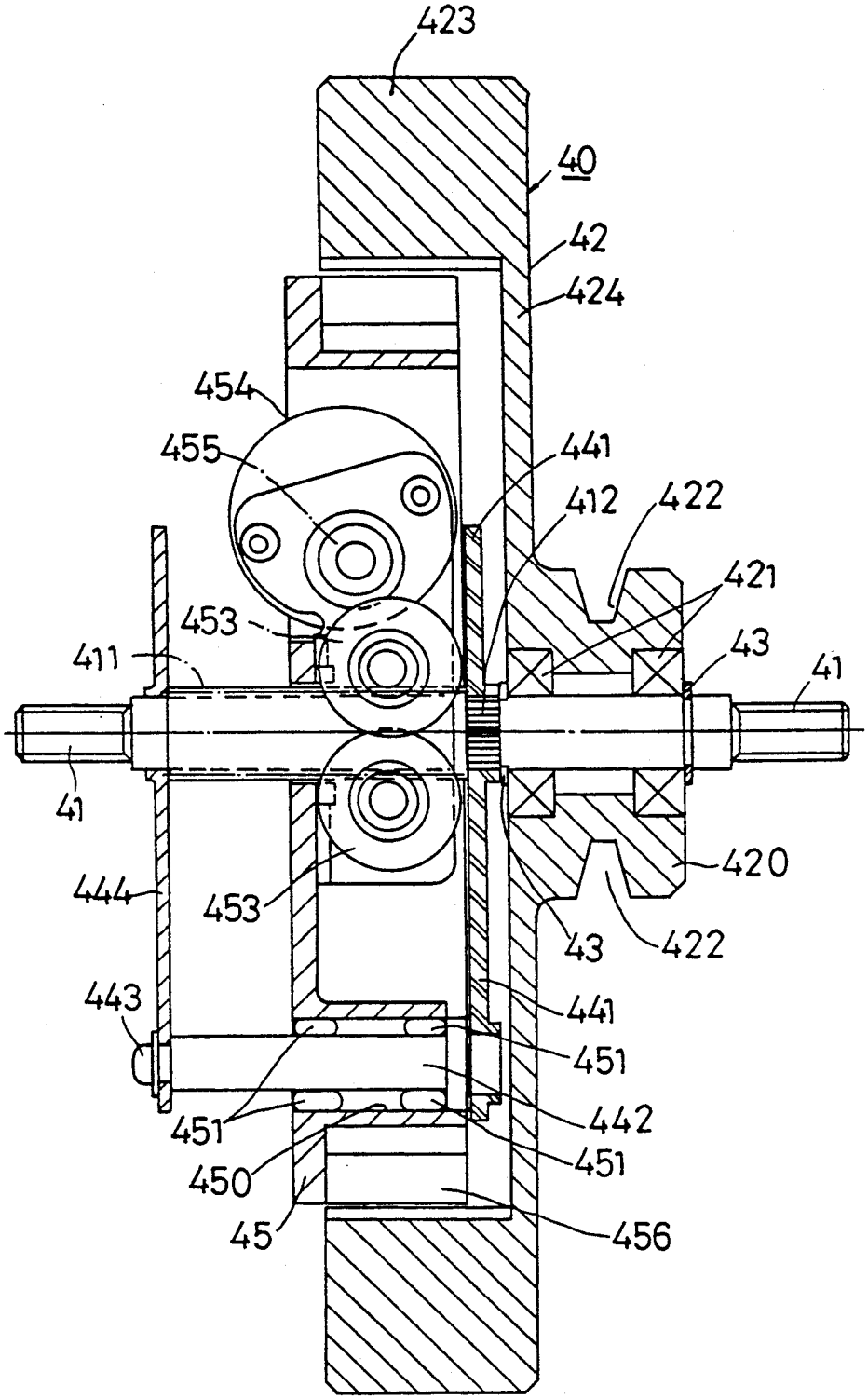
FIG. 8 is a sectional view of the magnet-type resistance generator shown in FIG. 7.

Referring to FIGS. 5 and 6, the preferred embodiment of an exercise apparatus according to the present invention is shown to comprise a frame assembly 10, a manually operated driving unit 20, a flywheel unit 30, a magnet-type resistance generator 40 and a pair of cover panels 50.

In this embodiment, the frame assembly 10 is an exercise bicycle frame and includes an H-shaped base 11, a vertical support member 12 which extends upwardly from a front portion of the base 11, and a seat support 13 which extends upwardly from a rear portion of the base 11. A horizontal frame member 14 extends from a top end of the vertical support member 12 to the seat support 13. A seat 18 is mounted on a top end of the seat support 13 in a known manner. The front end of the base 11 is formed with a tubular axle support 110. The axle support 110 has two open ends which are provided with a respective cap 112. An axle 111 is provided in the axle support 110 and has two ends that extend through the caps 112, thereby permitting the caps 112 to support rotatably the axle 111. Washers 114 and screw fasteners 115 are employed to mount a wheel 113 on each distal end of the axle 111. The wheels 113 facilitate moving of the exercise apparatus to a desired location. The base 11 is further provided with an oil collecting plate 116 on one side of the same. The rear end of the base 11 is provided with a ground contacting member 117. The ground contacting member 117 has two ends which are respectively provided with a foot pad 118 A U-shaped frame 119 is mounted on the base 11 adjacent to the vertical support frame 12. A mounting frame 121 is mounted on the vertical support frame 12 and extends above the U-shaped frame 119. A voltage regulator unit 122 is mounted on the vertical support frame 12 below the mounting frame 121. A positioning plate 123 is secured on the base 11 beside the vertical support frame 12. A power supply socket 124 is mounted on the positioning plate 123 and is adapted to be connected to an external power supply adapter 125 which is responsible for supplying dc power to the electrical components of the exercise apparatus.

The seat support 13 has a lower portion with an inner surface which is provided with a shaft sleeve 131. A support plate 132 is mounted on top of the shaft sleeve 131. A magnetic sensor 133 is mounted on the support plate 132. The seat support 13 is telescopic in construction and is provided with a retaining pin unit 134, a retractable shaft 135 and a cover member 136 which are arranged in a known manner.

The horizontal frame member 14 is provided with an upright hollow support 141 which is disposed above the mounting frame 121. An instrument support 15 has a lower end which is secured to the upright hollow support 141. The upper end of the instrument support 15 is provided with a handle unit 16 and an instrument control unit 17. The instrument support 15 is hollow so as to permit the passage of electrical wiring therethrough. The instrument support 15 is further provided with a cover member 151 to close the open top end of the upright hollow support 141.

The manually operated driving unit 20 includes a drive shaft 21, a driving sprocket 22, a magnet positioning seat 23, a magnet 24, a pair of crank arms 25, a pair of pedals 26 and an endless drive chain 27. The drive shaft 21 is received within the shaft sleeve 131. The driving sprocket 22 is mounted on one end of the drive shaft 21. The crank arms 25 are respectively secured to two ends of the drive shaft 21. The pedals 26 are respectively carried on the crank arms 25. The magnet positioning seat 23 is secured eccentrically o the driving sprocket 22 and receives the magnet 24 therein. The drive chain 27 is trained on the driving sprocket 22, thereby permitting movement of the drive chain 27 when the driving sprocket 22 rotates. The magnet 24 is aligned circumferentially with the magnetic sensor 133, thereby enabling the magnet 24 and the magnetic sensor 133 to serve as a detector unit for detecting the rotational speed of the driving sprocket 22.

The flywheel unit 30 is mounted on the mounting frame 121 at the vertical support frame 12. The flywheel unit 30 includes an axle 301, a driven sprocket 31 mounted on one end of the axle 301, and a flywheel, such as a belt wheel 32, mounted on the other end of the axle 301 The drive chain 27 is trained on the driven sprocket 31.

Referring to FIGS. 5 to 8, the magnet-type resistance generator 40 includes a central shaft 41 with two ends mounted on the U-shaped frame 119. A rotary plate 42, which is made of a magnetically conductive material, has a hub portion 420, a circular plate portion 424 and a peripheral ring 423. The hub portion 420 has an outer surface which is formed with an annular belt groove 422 and is mounted rotatably adjacent to one of the ends of the central shaft 41 by means of a pair of bearings 421. The circular plate portion 424 has a rear side secured to the hub portion 420. The peripheral ring 423 extends forwardly from a front side of the circular plate portion 424 and has a predetermined thickness. The rotary plate 42 has a hollow space which is confined by the circular plate portion 424 and the peripheral ring 423. The circular plate portion 424 is further formed with a plurality of heat dissipation holes (not shown). A 40° V-shaped endless driving belt 33 is trained between the hub portion 420 of the rotary plate 42 and the belt wheel 32, thereby permitting the rotary plate 42 to rotate with the belt wheel 32. Two C-shaped locking rings 43 are disposed on two sides of the rotary plate 42 and prevent axial movement of the rotary plate 42 on the central shaft 41.

The central shaft 41 has an intermediate worm section 411 and a serrated section 412 between the worm section 411 and one of the locking rings 43. A triangular first limit plate 441 is mounted securely on the central shaft 41 at the serrated section 412. The first limit plate 441 is formed with three forwardly extending guide rods 442 at three corners thereof. Screws 443 are employed to mount a triangular second limit plate 444 on distal ends of the guide rods 442. A movable slide seat 45 is disposed axially on the central shaft 41 and is mounted movably between the first and second limit plates 441, 444.

The slide seat 45 is not made of a magnetically conductive material and is formed with three throughholes 450 to permit the extension of the guide rods 442 therethrough. A pair of oil-containing bearings 451 are received in each of the through-holes 450 to permit smooth sliding movement of the slide seat 45 along the guide rods 442. The slide seat 45 is provided with a pair of worm shafts 452 which are disposed on two sides of the worm section 411 and which mesh with the latter. Each of the worm shafts 452 has one end which is provided with a transmission gear 453 that meshes with an output gear 455 of a motor unit 454. The motor unit 454 is also mounted on the slide seat 45. The slide seat 45 has an outer periphery which is provided with a plurality of angularly spaced magnets 456. The slide seat 45 extends into the hollow space of the rotary plate 42 such that the magnets 456 are disposed adjacent to the peripheral ring 423 of the latter. The magnets 456 generate a magnetic resistance to the rotation of the rotary plate 42. A brush unit 457 is connected to the other end of one of the worm shafts 452 and is associated operatively with a printed decoder circuit 458. The brush unit 457 rotates with the worm shaft 452 to contact different points on the printed decoder circuit 458 to enable the latter to generate different electrical signals corresponding to the position of the slide seat 45 relative to the rotary plate 42. A socket connector 459 is connected electrically to the printed decoder circuit 458 and is disposed below the latter. The socket connector 459 permits electrical connection among the printed decoder circuit 458, the voltage regulator unit 122, the magnetic sensor 133 and the instrument control unit 17. The cover panels 50 and three decorative strips 51, 52, 53 are installed after assembly of the preferred embodiment has been completed, as shown in FIG. 6.

Figure 9:
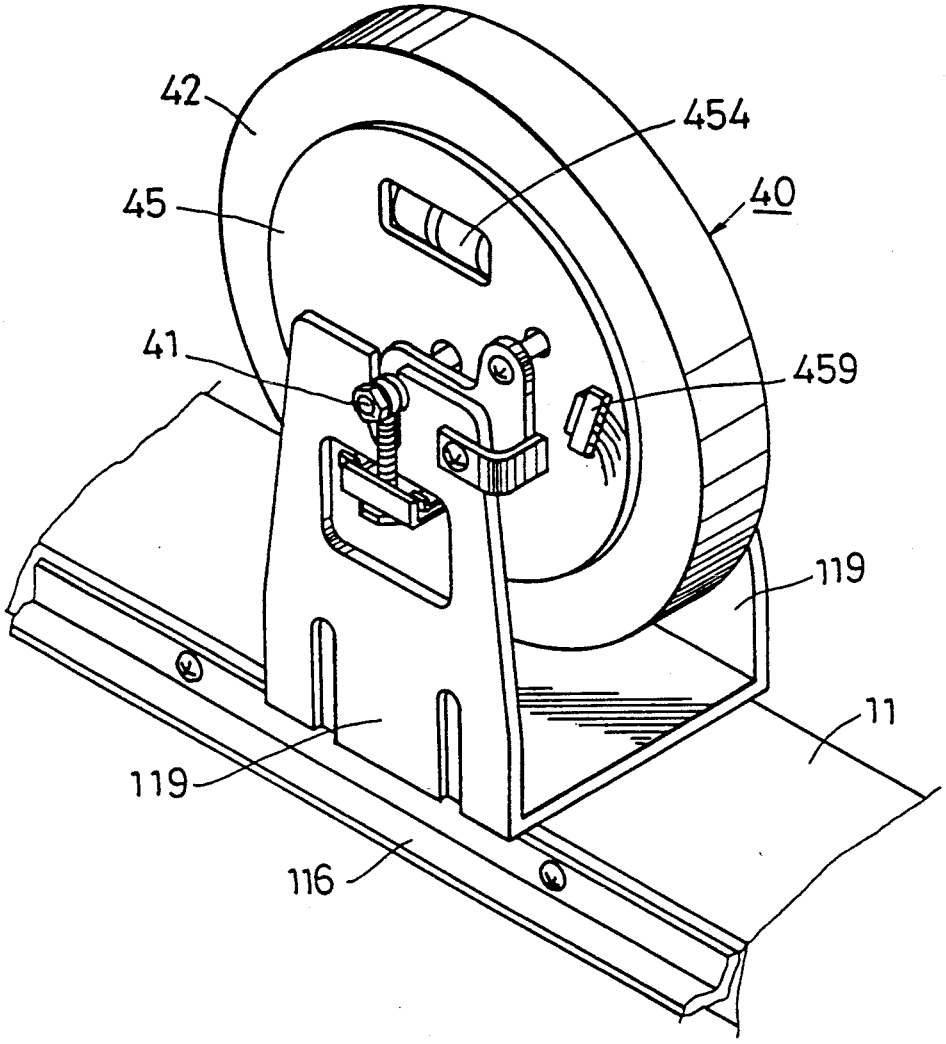
FIG. 9 illustrates the magnet-type resistance generator when in a maximum resistance state.
Figure 10:
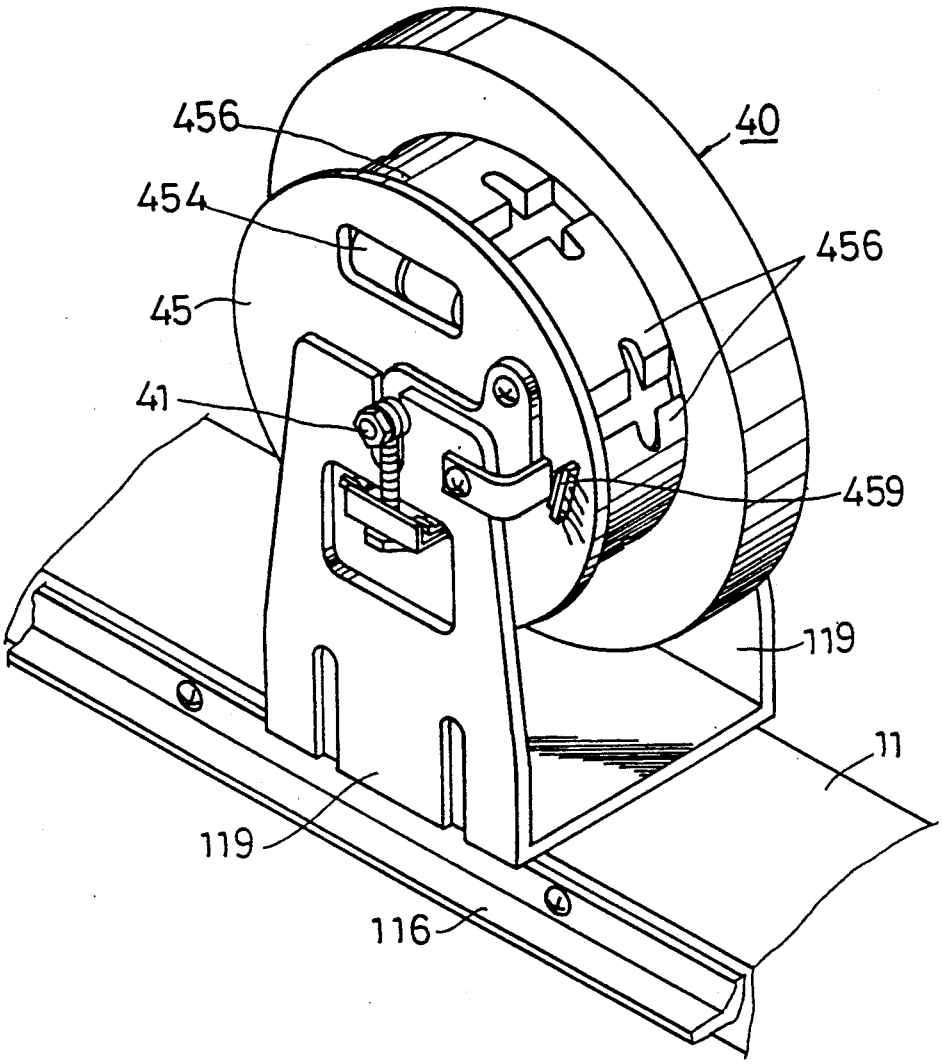
FIG. 10 illustrates the magnet-type resistance generator when in a minimum resistance state.
Figure 11:
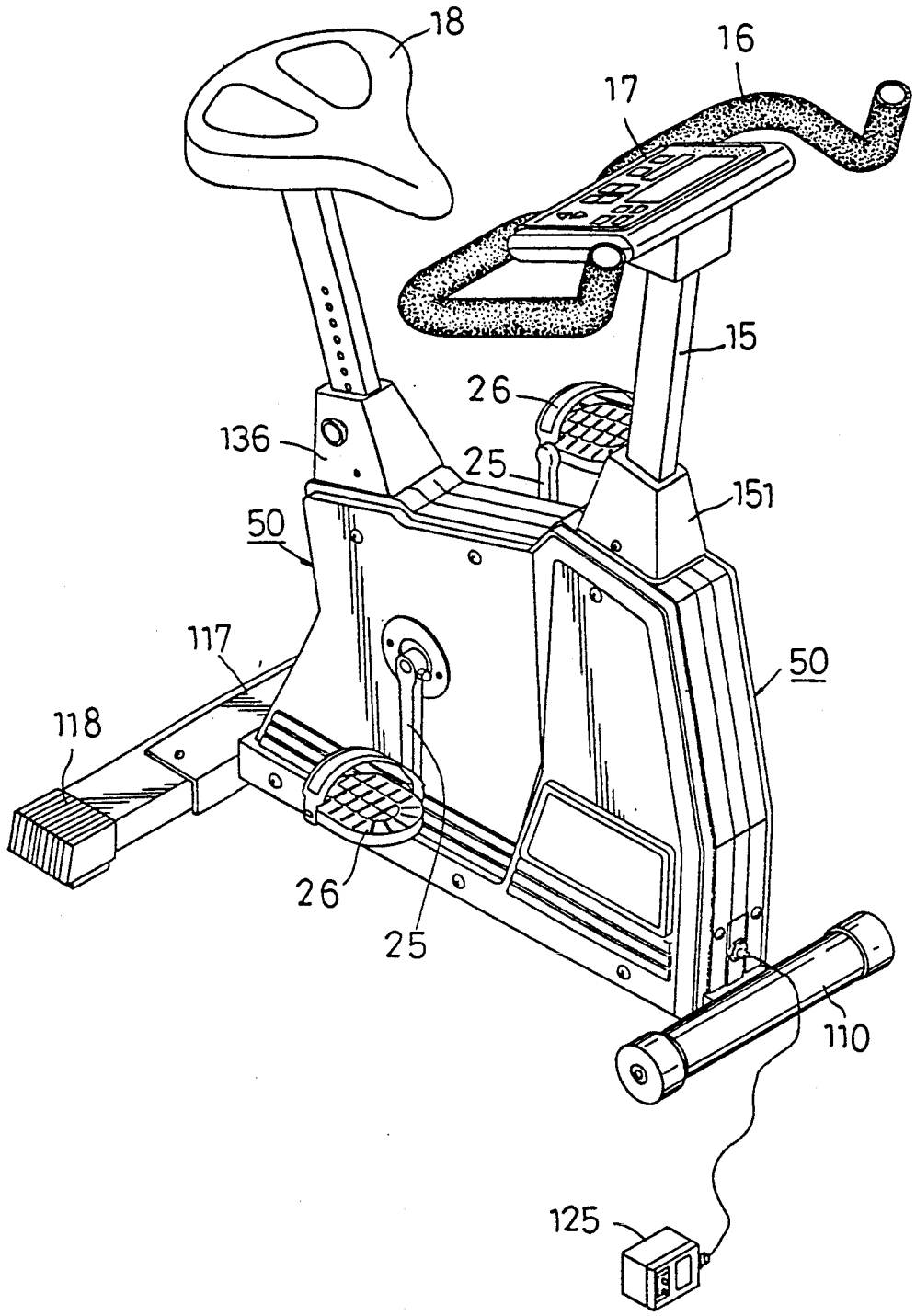
FIG. 11 is a fully assembled perspective view of the preferred embodiment.

The operation of the preferred embodiment is described briefly as follows: The power supply adapter 125 is connected to the power supply socket 124 to permit operation of the exercise apparatus. Referring to FIGS. 5 to 11, the instrument control unit 17 is initially operated in order to select a preset simulated road condition. The instrument control unit 17 controls the motor unit 454 to rotate synchronously the worm shafts 452. Since the worm shafts 452 mesh with the worm section 411, rotation of the worm shafts 452 results in movement of the slide seat 45 toward or away from the rotary plate 42, thereby varying the strength of a magnetic field which is applied by the magnets 456 on the peripheral ring 423 of the rotary plate 42 to vary correspondingly the magnetic resistance which is provided by the resistance generator 40. Referring to FIG. 9, the resistance to the rotation of the rotary plate 42 increases when the slide seat 45 moves toward the latter. Referring to FIG. 10, the resistance to the rotation of the rotary plate 42 decreases when the slide seat 45 moves away from the latter. Since the rotary plate 42 is driven rotatably by the flywheel unit 30, the resistance generator 40 provides the necessary resistance to the rotation of the flywheel unit 30 in order to enable the user to lose a desired amount of calories.

The magnet-type resistance generator 40 of the preferred embodiment has a relatively small tolerance. Since the slide seat 45 is always maintained in a central position with respect to the hollow space that is confined by the rotary plate 42, the rotary plate 42 is not subjected to an uneven magnetic field. Therefore, an unstable resistance to the rotation of the flywheel unit 30 seldom occurs. The exercise apparatus of the present invention is thus more comfortable to use when compared to the previously described conventional exercise apparatus.

Note that the exercise apparatus of the present invention may be configured as an exercise bicycle, a stationary rower, and the like. In addition, proper installation and adjustment of the resistance generator 40 can be achieved with ease. Should the exercise apparatus bump accidentally into an object when moving the same to a desired location, the slide seat 45 can be maintained in its proper position relative to the rotary plate 42. Furthermore, because of the provision of the brush unit 457 and the printed decoder circuit 458, the instrument control unit 17 is capable of determining the position of the slide seat 45 relative to the rotary plate 42 in order to determine accurately the resistance to the rotation of the rotary plate 42. Therefore, an accurate calorie loss can be computer by the instrument control unit 17.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An exercise apparatus including a frame assembly, a flywheel unit mounted rotatably on said frame assembly, a manually operated driving unit for driving rotatably said flywheel unit, and a magnet-type resistance generator to provide resistance to rotation of said flywheel unit, said resistance generator comprising:

a central shaft mounted on said frame assembly and formed with an intermediate worm section;

a rotary plate mounted rotatably on said central shaft on one side of said worm section and driven rotatably by said flywheel unit, said rotary plate being made of a magnetically conductive material and having a circular plate portion and a peripheral ring which extends from a front side of said circular plate portion and which has a predetermined thickness, said rotary plate having a hollow space which is confined by said circular plate portion and said peripheral ring;

a movable slide seat disposed axially on said central shaft, said slide seat including mounting means for mounting movably said slide seat along said central shaft and being provided with a worm shaft unit which meshes with said worm section and a motor means for rotating said worm shaft unit, said slide seat extending into said hollow space of said rotary plate and having an outer periphery which is provided with a plurality of angularly spaced magnets that are disposed adjacent to said peripheral ring of said rotary plate; and a motor control means connected to said motor means and operable so as to activate said motor means to rotate said worm shaft unit and cause movement of said slide seat in and out of said hollow space of said rotary plate to vary strength of a magnetic field applied by said magnets on said peripheral ring of said rotary plate and vary correspondingly magnetic resistance to rotation of said rotary plate and said flywheel unit.

2. The exercise apparatus as claimed in claim 1, wherein said motor control means comprises a detecting means for detecting a position of said slide seat relative to said rotary plate to determine accurately the resistance to the rotation of said rotary plate and said flywheel unit, said detecting means including a printed detector circuit secured on said slide seat and a brush unit connected to said worm shaft unit, said brush unit rotating with said worm shaft unit to contact different points on said printed detector circuit to enable said printed detector circuit to generate different electrical signals corresponding to the position of said slide seat relative to said rotary plate.

3. The exercise apparatus as claimed in claim 1, wherein said mounting means comprises a first limit plate disposed on said one side of said worm section adjacent to said circular plate portion of said rotary plate and formed with a plurality of forwardly extending guide rods, and a second limit plate mounted on distal ends of said guide rods, said slide seat being disposed between said first and second limit plates and being formed with a plurality of throughholes which permit extension of a respective one of said guide rods therethrough.

* * * * *